US005918302A

United States Patent [19]

Rinn

[11] Patent Number: 5,918,302

[45] Date of Patent: Jun. 29, 1999

[54] DIGITAL SOUND-PRODUCING INTEGRATED CIRCUIT WITH VIRTUAL CACHE

[75] Inventor: Laurent Rinn, Bierre Les Semur, France

[73] Assignee: Atmel Corporation, San Jose, Calif.

[21] Appl. No.: 09/148,437

[22] Filed: Sep. 4, 1998

[51] Int. Cl.[6] ..... G10H 7/02

[52] U.S. Cl. ..... 84/604

[58] Field of Search ..... 84/603–607

[56] References Cited

U.S. PATENT DOCUMENTS

| | | | |
|---|---|---|---|
| 5,111,727 | 5/1992 | Rossum | 84/603 |
| 5,342,990 | 8/1994 | Rossum | 84/603 |
| 5,613,147 | 3/1997 | Okamura et al. | 395/800 |
| 5,698,803 | 12/1997 | Rossum . | |
| 5,753,841 | 5/1998 | Hewitt | 84/604 |

OTHER PUBLICATIONS

Chris Deforeit et al., "A Music Synthesizer Architecture which Integrates a Specialized DSP Core and a 16–bit Microprocessor on a Single Chip", presented at the 98th Convention of the Audio Engineering Society on Feb. 25, 1995.

*Primary Examiner*—Stanley J. Witkowski
*Attorney, Agent, or Firm*—Thomas Schneck; Mark Protsik

[57] ABSTRACT

A digital sound-producing device having a digital signal processor (DSP) and data cache memory, and using an external sample memory for storing digital audio sample data, includes a virtual cache memory block for dynamically allocating cache lines of the data cache memory. The virtual cache memory block is located in the address path between the DSP and both the data cache memory and sample memory, while the data cache memory is on the data path between the DSP and sample memory. Requests by the DSP for access to the sample memory are in the form of a virtual address corresponding to a particular sample memory address. The virtual cache memory block determines whether the virtual address already has an allocated cache line for the data cache memory, and if so transfers the requested data between that cache line and the DSP. If not, it allocates a data cache line as corresponding to the virtual address, and transfers data from the corresponding sample memory address to the cache line. The sample data is then available to the DSP in the next processing time frame.

14 Claims, 3 Drawing Sheets

DIGITAL SOUND-PRODUCING INTEGRATED CIRCUIT WITH VIRTUAL CACHE

TECHNICAL FIELD

The present invention relates to electrical musical tone generation, and particularly to digital audio signal processing systems that employ digital audio sample memory and data cache memory for use by the processing systems in sound synthesis.

BACKGROUND ART

The increasing use of MIDI and music synthesis capabilities in electronic musical instruments, Karaoke and PC multimedia applications is fueling the demand for high performance, yet cost effective, sound production systems. Digital sound synthesizing and processing systems make use of digital audio sample memory for a variety of purposes, including as a wavetable memory storing audio samples for synthesizing sounds, as a delay buffer memory for reverb and chorusing effects processing, and as a streaming audio memory receiving audio samples from external audio inputs such as a music keyboard, microphone, or the hard disk of multimedia PC. Such systems also employ a data cache memory in order to reduce the number of required accesses of the sample memory, and thereby minimize bottlenecks in this time-critical environment. One example of an audio signal processor integrated circuit architecture for music synthesis applications is described by Chris Deforeit et al., in a paper entitled "A Music Synthesizer Architecture which Integrates a Specialized DSP Core and a 16-bit Microprocessor on a Single Chip", presented at the 98th Convention of the Audio Engineering Society (AES) on Feb. 25, 1995. It has been embodied in the SAM9407 integrated sound studio circuit sold by Dream S.A. of Semur-en-Auxois, France, a subsidiary of Atmel Corporation of San Jose, Calif., the assignee of the present invention.

The aforementioned circuit architecture combines a synthesis digital signal processor (DSP) core, a control processor, a memory management unit, and peripheral I/O interface logic on a single chip. The synthesis DSP is constructed with hardware that has been optimized for the music synthesis task, and by repeatedly and efficiently performing a limited number of operations needed to carry out synthesis-specific algorithms, it directly generates and processes up to 64 simultaneous voices using the digital audio sample data accessed from external sample memory. The DSP synthesis algorithms are stored in on-chip program memory, while parameter data for the synthesized voices are stored in blocks of on-chip parameter memory. The control processor interfaces with external peripheral devices, such as a host computer or MIDI keyboard, through the peripheral I/O logic. The control processor parses and interprets incoming commands and data from such peripheral devices, and then controls the synthesis DSP by writing into the DSP's parameter memory. Besides these command parsing and control tasks, the control processor can also perform slowly changing synthesis operations, such as low frequency oscillation and waveform envelope management, by periodically updating synthesis parameters in the parameter memory. The memory management unit allows external memory resources to be shared by both the control processor and synthesis DSP. Thus, for example, a single external ROM device may serve as both program memory for the control processor and sample memory for the DSP, and a single external RAM device may serve as both external data memory for the control processor and delay buffer memory for the effects processing done by the DSP.

The synthesis DSP operates on a frame timing basis with each synthesis frame divided into several process slots (e.g., 64 slots in the aforementioned SAM 9407 device). A 'process' relates to an elementary sound production function, such as one voice wavetable synthesis, one delay line for effects, etc., and each process generally involves reading or writing one or more audio samples from or to the digital audio sample memory. The maximum number of processes that can be executed within one synthesis frame (i.e., the number of slots) determines the capability of the device. For example, if all process slots were dedicated to wavetable synthesis, the number of slots would be the maximum polyphony (although slots might also be linked together to implement more complex synthesis algorithms). Also, some number of slots (e.g., eight) may be required for effects processing, leaving fewer slots available for polyphonic wavetable sound synthesis.

It is desirable to increase the number of processing slots per synthesis frame. Because each processing slot typically requires at least two digital audio sample memory accessed per frame, a 128 slot device would need 256 or more accesses per frame. With a state of the art frame rate of 48 kHz, this leads to sample memory cycles of at most 81 ns. Fortunately, in most cases, the same audio sample has to be accessed on successive frames. Thus, potential traffic bottlenecks between the synthesis DSP and the sample memory can be avoided by using an on-chip data cache memory to minimize the number of sample memory accesses that are needed. In a straightforward implementation, where the data cache has memory space for at least two audio samples allocated to each slot, the cache memory size in samples is at least twice the number of slots. With a typical audio sample width of about 16 or 24 bits, the data cache would need to hold a minimum of 4 or 6 kbits for a 128-slot device.

However, it is further desirable in a multimedia PC environment for the digital audio sample memory to share the PC's main memory instead of using separate ROM and RAM. But, the structure of modern PC buses (such as PCI) uses a memory word width of 256 bits (referred to as a PC cache line). Thus, a regular implementation of a synthesis DSP's data cache memory usable in such a PC memory sharing environment would require two PC cache lines per processing slot, and hence a size of at least 64 kbits of on-chip cache for a 128-slot device.

It is an object of the present invention to implement an improvement in cache memory organization for sound synthesis DSP applications that results in a significant reduction in the required size of the data cache memory.

It is another object of the present invention to optimize the synthesis DSP cache management to the large cache line structure of modern PC buses in order to improve transfers of audio sample data between the sample memory located on the PC's main board and the on-chip data cache memory.

It is a further object of the invention to provide for variable digital audio sample memory word sizes.

DISCLOSURE OF THE INVENTION

These objectives are met by a digital sound producing integrated circuit device that uses external sample memory for storing digital audio data samples, wherein the on-chip data cache memory organization is not correlated to the synthesis slots, but rather employs an additional virtual cache memory to dynamically allocate real data cache memory lines to the various slots, as needed.

In particular, the digital sound-producing device includes a digital signal processor (DSP) core that requests access to the sample memory by supplying a virtual address to a virtual cache memory block. The device also includes a data cache memory in a data path between the DSP and the sample memory. The data cache memory stores, in cache lines thereof, audio sample data, including data that has been read from the sample memory for use by the DSP and data that has been written thereto by the DSP. The device further includes the aforementioned virtual cache memory block, which is located in an address path between the DSP and both the sample memory and the data cache memory. The virtual cache memory block receives the virtual addresses from the DSP requesting access to the sample memory, and determines whether that address already corresponds to an allocated cache line of the data cache memory. If not, it allocates a new cache line as corresponding to the virtual memory and addresses the sample memory for transfer of the audio sample data to the cache line. The data is available to the DSP during the next processing frame. If a cache line corresponding to the virtual address has already been allocated, the virtual cache memory block addresses the data cache memory for transfer of audio sample data between that corresponding cache line and the DSP. The virtual cache memory block also de-allocates cache lines not used in the current or previous frame, addressing the sample memory for transfer of the audio sample from the data cache to the sample memory. The virtual cache memory block includes a data line table storing, for each virtual address, the corresponding allocated data cache address, and also includes a virtual cache address table and other circuitry for processing current access requests, as described in further detail below.

The sample memory can be a ROM or flash memory, a RAM or DRAM, and may be indirectly accessed through a PC bus. A cache line transfer between the sample memory and the data cache memory may consist of a burst of several access (read or write) cycles. For example, where the data cache memory is a DRAM, the transfer may be a burst of several DRAM fast page mode access cycles. The audio sample data blocks stored in the data cache memory may match the cache line size for a personal computer (PC) or the audio samples can have different sizes in various cache lines of the data cache. Likewise, the data read by the DSP from the data cache can have a variable number of bits, as requested by the DSP. The virtual address provided by the DSP may be the same as the corresponding sample memory address. Alternatively, the virtual cache memory block could access the sample memory by shifting the received virtual address by a quantity commensurate with the audio sample word size and adding the result of that shift to a base register (or several base registers) to provide the sample memory address. The virtual cache memory block can also handle any data cache memory full situations by providing the previous audio sample, instead of no sample, and thus avoid audio clicking.

BEST MODE OF CARRYING OUT THE INVENTION

Figure 1:
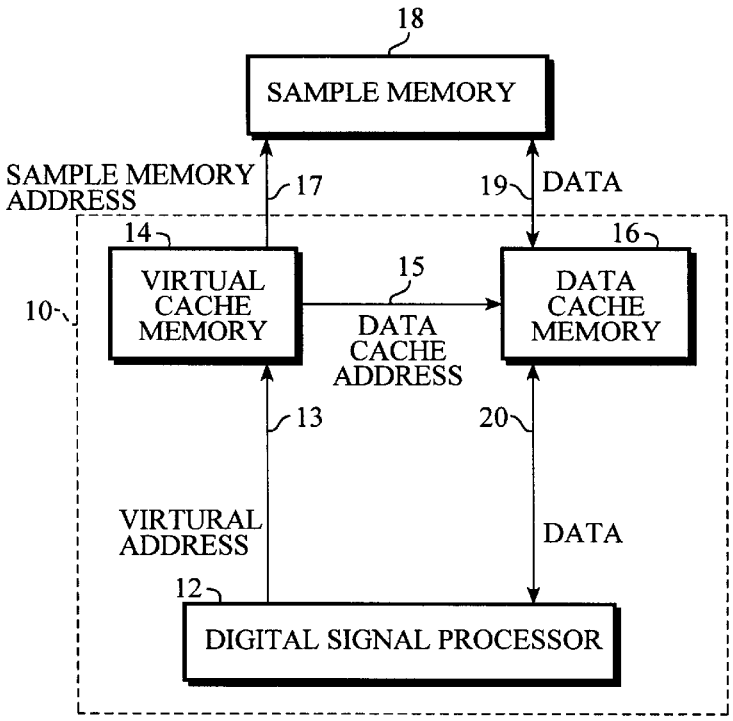
FIG. 1 is a schematic block diagram of a digital sound-producing integrated circuit device of the present invention together with an external sample memory, with the address and data paths shown.

With reference to FIG. 1, that portion of the digital sound producing integrated circuit 10 that is responsible for synthesizing and processing an audio signal, namely the digital signal processor (DSP) core 12, and for interfacing the DSP with an external digital audio sample memory 18, namely the cache memory structure of the present invention combining a data cache memory 16 with a virtual cache memory 14, is shown together with their main address and data paths. For the sake of clarity, control signals are omitted from this figure.

The sample memory 18 stores successions of individual audio samples as an audio stream. For a given audio stream, the samples might be 8, 16 or 32 bits wide, and can be organized in a multichannel interleaved way. The sample memory 18 is represented as a conventional functional block only and will not be further detailed. It is essentially the same as any of those used in prior sound synthesis applications. For example, it could be a ROM or DRAM device, or it might be the memory of a personal computer (PC), accessed from a PC cache memory through a PCI bus. It is accessed via data I/O lines 19 by the sound chip 10 by providing a sample memory address on chip output lines 17.

The DSP core 12 provides an address corresponding to an audio sample on an address line 13, together with a read or write request, to a virtual cache memory block 14. Because the DSP 12 does not in the present invention directly address either sample memory 18 or data cache memory 16, the address on bus 13 is referred to as a 'virtual' address, which is used by the virtual cache memory block 14 to determine the appropriate real address of either memory 16 or 18. In the case of a write request, the DSP 12 also provides the actual data to be written on a data bus 20 connected to the data cache memory 16.

The virtual cache memory 14 receives the virtual address on bus 13 from the DSP 12 and allocates a new or already existing data cache address corresponding to a cache line of the data cache memory 16. (Details for this allocation will be explained below.) At this point, if a read operation has been requested by the DSP 12, the virtual cache memory block 14 will decide whether the audio sample data can be read directly from the on-chip data cache 16 or if an access to the external sample memory 18 is necessary. If access to the sample memory 18 is necessary, the virtual cache memory 14 will calculate a sample memory address from the received virtual address, the contents of one or more base registers (optional) and the sample width. It will then provide the sample memory address over external address bus lines 17 to the sample memory 18 and initiate a sample memory to data cache line write cycle, which will transfer data read from the sample memory 18 over data lines 19 to the allocated data cache memory line indicated by a data cache address applied on bus 15. If the requested data is already stored in the allocated cache line, then no access to the sample memory 18 is necessary and the requested data will be made available to the DSP 12 over data bus 20 on the next synthesis frame. If a write request has been requested by the DSP 12, the audio sample provided on data bus 20 from the DSP 12 will be stored into the allocated data cache line of the data cache 16, as indicated by the data cache address provided on bus 15 from the virtual cache 14 to the data cache memory 16. (The write from the data cache 16 to the sample memory 18 will be explained later.)

Figure 2:
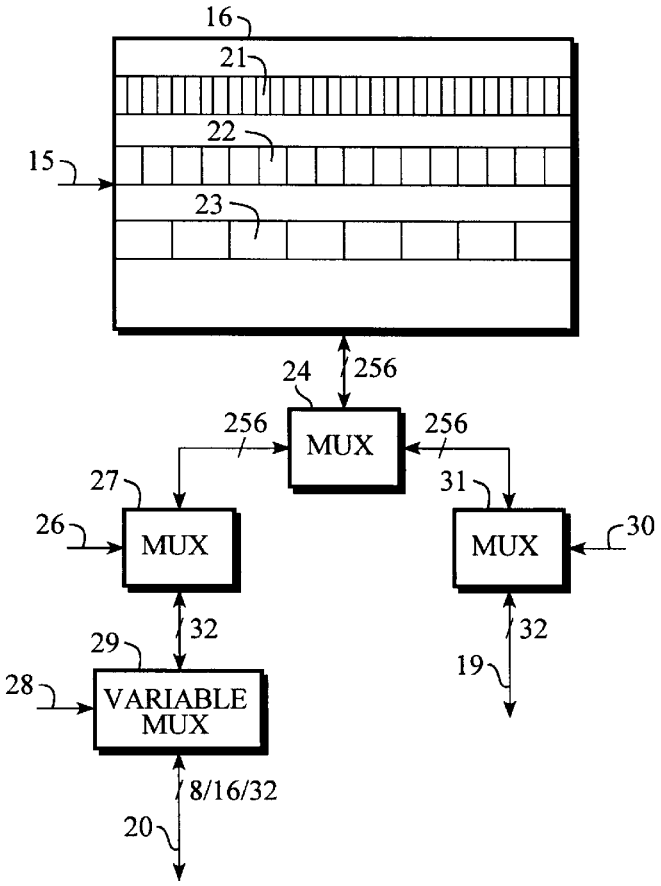
FIG. 2 is a schematic block diagram of a data cache memory in the device of FIG. 1 together with associated input/output selection elements therefor.

With reference to FIG. 2, the data cache memory block 16 preferably has a cache line width of 256 bits and a bus width for data bus 19 to or from the sample memory of 32 bits, as is typical for PC memory sharing applications through a standard PCI bus. However, any other size cache line and bus width can be designed as long as one cache line can store at least one audio sample. As is seen for the preferred 256-bit cache line size, one cache line can hold either 32 8-bit audio samples (represented by cache line 21), 16 16-bit audio samples (cache line 22) or 8 32-bit audio samples (cache line 23). The sample width selection is controlled from the DSP to the virtual cache memory. The data cache memory 16 can be implemented as a single-port SRAM, as shown. Alternatively, it may be implemented with dual-port RAM for optimum performance when communicating with fast PC buses.

The data cache memory 16 receives an address on bus 15 from the virtual cache memory block and reads (or writes) sample data from (or to) either the audio sample memory through a PCI data bus 19 or the DSP through data bus 20. Selection of bus 19 or 20 is controlled by the virtual cache memory block through a multiplexer 24. When communicating with the PCI bus 19, a full 256-bit cache line is read (or written) using a burst mode of 8 32-bit transfers, using a multiplexer 31 with control inputs 30. This way of making such a transfer is well known to those skilled in the art and fully detailed in the PCI bus specification. When communicating with the DSP through data bus 20, the audio sample transfers occur on an individual audio sample basis, which can be 8, 16, or 32 bits wide. These transfers are controlled by the virtual cache memory block using control signals 26 and 28. In particular, when reading the data cache 16, the correct audio sample is selected by means of multiplexers 27 and 29. When writing to the data cache 16, two implementations are possible. Either a read/modify/write cycle can be used to store the audio sample at the correct position in the cache line, or several write enable signals to the data cache memory can enable modification of only the necessary portion of the stored cache line.

Figure 3:
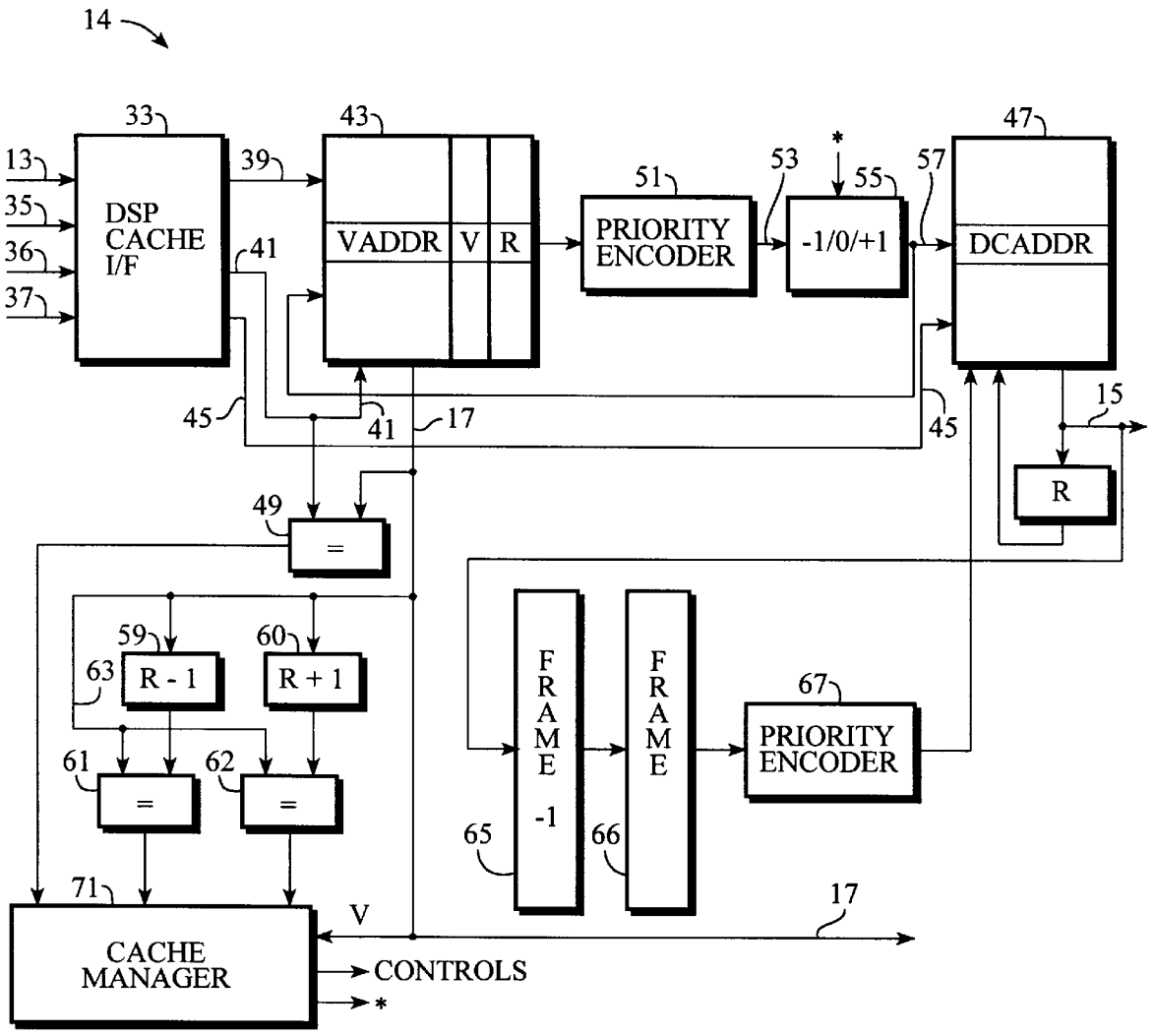
FIG. 3 is a schematic block diagram detailing a virtual cache memory block in the device of FIG. 1.

With reference to FIG. 3, the virtual cache memory block 14 includes a DSP-cache interface 33. The interface 33 has signal inputs 13 and 35–37 receiving, respectively, the virtual address, the current processing slot number, the current access request number for the current slot, and the current read/write request number for the current slot. Each of these inputs is connected to corresponding outputs from the DSP. The interface 33 also has signal outputs 39, 41 and 45 connected to a virtual cache address table 43 and a virtual cache data line table 47. When requesting access, the interface 33 provides a virtual cache address on signal lines 39 addressing the virtual cache address table 43 and the virtual address on lines 41 to data inputs of the address table 43. When accessing data in a read or write operation, the interface 33 provides the current DSP virtual cache address to the virtual cache data line table 47 in order to retrieve the stored corresponding data cache address.

The virtual cache memory block 14 also includes a virtual cache address table 43. The size of this table corresponds to the maximum of sample memory accesses that can be performed within a single frame. It holds, for each possible access, the current virtual address (VADDR), a valid bit (V), and a request bit (R) that indicates whether that virtual address is actually requesting access. For technology reasons, the virtual cache address table 43 is preferably made up of two devices, namely a random access memory or RAM that holds the virtual address byte (VADDR) and the valid bit (V), and a register bank that holds the request bits (R). In one implementation, the current virtual address (VADDR) is sent as the sample memory address on address lines 17. An equality comparator 49 compares the incoming virtual address 41 from the interface 33 to the virtual address (VADDR) stored in the virtual cache address table 43 that is output on lines 17. This comparison is performed with the lower 5 bits masked, therefore indicating to the cache manager 71 whether the requested data is already present in a cache line of the data cache.

A priority encoder 51 receives all request bits (R) in parallel from the register bank of the virtual cache address table 43. It determines which virtual cache address (VCADDR) is requesting service (R=1). The priority encoder 51 outputs that virtual cache address (VCADDR) to an increment/decrement device 55 that outputs either VCADDR−1, VCADDR, or VCADDR+1, as determined by control signals (*) from the cache manager 71. That output 57 in turn accesses both the virtual cache address table 43 and the virtual cache data line table 47. Therefore, it is possible from a given virtual cache address (VCADDR) to also read the previous or next virtual cache address as well. The virtual addresses read from these previous and next virtual cache addresses, with the lower 5 bits masked, can be stored, respectively, into two registers 59 and 60. Two equality comparators 61 and 62 compare these virtual addresses, with the lower 5 bits masked, with the corresponding current virtual address from the cache address table 43 to determine whether the addresses refer to the same data cache line, and indicate this to the cache manager 71.

The virtual cache memory block 14 also includes a virtual cache data line table 47. This table, which can be implemented as standard RAM, has the same size as the virtual cache address table 43. It holds, for each active entry, the address (DCADDR) of the corresponding cache line of the data cache. To allocate a free data cache line, two register banks 65 and 66 and a priority encoder 67 is used. Each "in-use" register bank 65 and 66, for the current FRAME and previous FRAME−1, has a size equal to the number of storage locations of the tables 43 and 47. Each bit of these register banks indicates that the corresponding data cache line is already in use. The priority encoder 67 indicates which is the first register bit set at zero (free or not in use), and therefore the priority encoder's output is the first available data cache address (DCADDR) that can be assigned to correspond to a virtual address.

A cache manager block 71 is used to sequence all operations concerning a request from the virtual cache address table 43. The cache manager 71 receives information from various elements 43, 49, 61 and 62 of the block 14 of FIG. 3, and sequentially generates control signals. The cache manager 71 can be implemented using a microprogram, a PLA, or a truth table decoded with gates, as is well known in the art. Operation of the virtual cache memory block 14 will be further described below.

Figure 4:
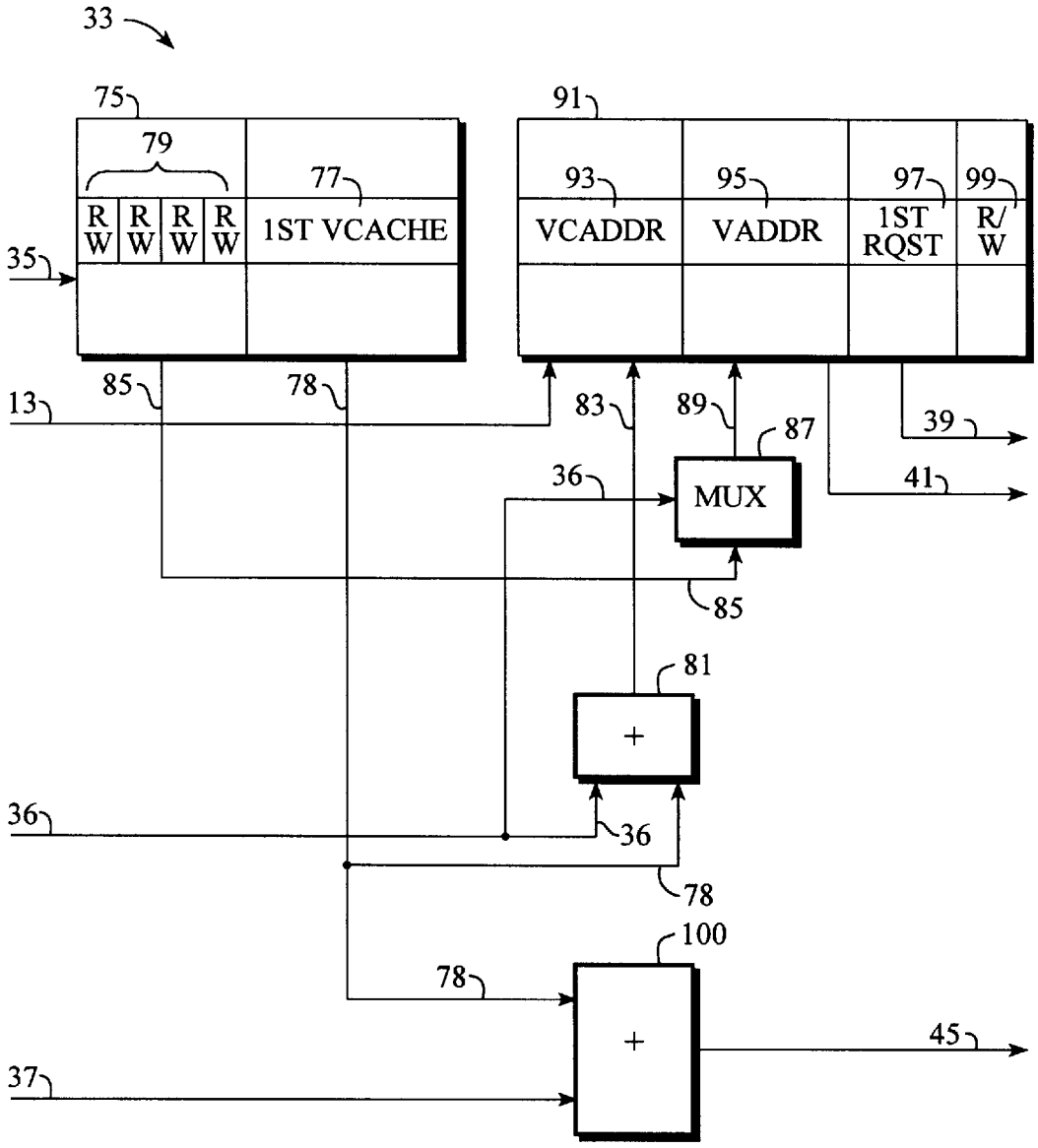
FIG. 4 is a schematic block diagram further detailing a DSP-cache interface in the virtual cache memory block of FIG. 3.

With reference to FIG. 4, the DSP cache interface 33 of FIG. 3 includes a virtual cache configuration table 75, a first-in first out (FIFO) memory 91, adders 81 and 100 and a multiplexer 87. The configuration table 75 is equal in size to the number of processing slots from the DSP. It receives the current slot number from the DSP on input lines 35. For each slot, it indicates in a field 77 the first virtual cache address (1st Vcache) that should be used, as well as indicating in a field 79 the successive read or write operations (R/W) to be performed within one slot. The number of individual bits in the field 79 to indicate such successive operations is equal to the maximum number of memory accesses that can be performed within one slot (e.g., four in the depicted implementation). The virtual cache configuration table 75 is loaded once by the DSP for a given synthesis/processing configuration. If an application uses a fixed configuration, then the table 75 can be implemented as ROM.

When requesting a sample memory access, the DSP provides, besides the slot number on input 35, the virtual address (VADDR) for the access on input 13 (to the FIFO memory 91), and the access request number within the slot on input 36. The adder 81 adds the access request number to the slot's first virtual cache address (1st Vcache) received on line 78 from the field 77 of the configuration table 75 to provide on line 83 a current virtual cache address (VCADDR) to the FIFO memory 91. The individual read/write access bits (R/W) in field 79 of the configuration table 75 are output on line 85 and selected by multiplexer 87, using the access request number from input 36 as a selection control signal. The multiplexer 87 thus provides a bit on output 89 to the FIFO memory 91 indicating whether this particular access is a read or a write.

The FIFO memory 91 has fields 93, 95, 97 and 99 respectively storing the current virtual cache address (VCADDR), the virtual address for the access (VADDR), a bit indicating whether this is a first request for the slot (1st RQST), and the read/write bit (R/W) indicating the type of access requested. The FIFO memory 91 files all access requests from the DSP and has a size which is twice the maximum access count for a slot. The virtual cache address (VCADDR) and the virtual address (VADDR) together with the corresponding request bits in fields 97 and 99 are provided by the FIFO memory 91 on outputs 39 and 41 for loading into the virtual cache address table 43 in FIG. 3.

When requesting data access, the DSP also provides the current read/write request number for the current slot on an input 37, which is added by adder 100 to the first virtual cache address (1st Vcache) received from the configuration table 75 on lines 78 so as to provide the current DSP virtual cache address on line 45 to the data line table 47 of FIG. 3.

The operation of the device is best understood using the following examples. It should be first understood that all data transfers occur with one DSP frame delay. That is, the DSP requests access at frame F and then transfers data at frame F+1. This gives the virtual cache memory block 14 a full frame to obtain the requested data from the sample memory. This is particularly important whenever the sample memory is accessed through a PCI bus or any other bus in which several agents may simultaneously request service on the bus.

Read Example

We suppose that DSP slot #3 wants to access two successive samples at address 1000H (H means hexadecimal notation). This is a typical case in synthesis using linear interpolation (Linear interpolation is the easiest method to determine the approximate value of an unknown sample between two consecutive samples. A more accurate method involves convolution.) Both methods are well known by those skilled in the art and have been described in detail in the book "Musical Applications of Microprocessors" by Hal Chamberlain, Hayden Book Company 1985).

Referring to FIG. 4, slot #3 will access the Vcache config table 75 providing the first Vcache address (for example, 10) from field 77. The first two individual bits in field 79 would be zero to indicate read operations. Two writes will occur into the FIFO memory 91 during the slot:

First Write

Vcache address=10,

Virtual address=1000H, first request=1,

R/W=0,

Second Write

Vcache address=11,

Virtual address=1001H, first request=0,

R/W=0

During next slot (slot #4), the FIFO memory 91 will be read, until it is empty or a first request bit in field 97 is set (meaning that the DSP is currently filling the FIFO during slot #4). After the FIFO read, the content of the Vcache address table 43 (FIG. 3) will be:

Address 10: virtual address 1000H, VALID=0, RQST=1
Address 11: virtual address 1001H, VALID=0, RQST=1

At this point we will detail the cache manager control logic operation from FIG. 3. Because RQST bits have been set, the priority encoder 51 will indicate Vcache address 10 requesting service. The cache manager 71 will look at the previous Vcache address (9) and the next Vcache address (11) checking for VALID bits. These bits not being set, the cache manager will allocate a new cache data line, by writing the first available data cache address given by the priority encoder 51 (for example 3) to the Vcache data line table 47. It will then execute a sampling memory access burst cycle which will fill the data cache memory 16 at address 3 (FIG. 2) with a cache line (byte addresses 1000H to 101FH). It will then set the VALID bit and reset the RQST bit for Vcache address 10.

The RQST bit from Vcache address 10 being reset, the priority encoder will indicate Vcache address 11 requesting service. The cache manager 71, looking at the previous Vcache address (10), will find the VALID bit set. It will find also that the Vcache address 10 holds the same virtual address as Vcache address 11 with the lower 5 bits masked (Using the R-1 storage 59 and the equality comparator 61). Consequently it will assign the same data cache address (3) to Vcache address 11 as Vcache address 10, by reading the data cache address (3) from address 10 of Vcache data line table 47 into the temporary register R and writing R back to Vcache data line table 47 at address 11. The cache manager 71 will then set the VALID bit and reset the RQST bit for Vcache address 11.

Assuming that no other RQST are pending, the cache manager 71 will enter an idle state until next frame.

At next frame slot #3, the DSP can now read the datum requested at previous frame. The slot #3 accesses the Vcache config table 75 (FIG. 4) providing the first Vcache address (10). The first access (0) added by adder 81 to the first Vcache address provides a DSP Vcache address 10, which through the Vcache data line table 47 indicates data cache address 3. The data cache is read at address 3 to provide the correct data to the DSP. Similarly the second access (1) will read the same data cache line.

If the virtual addresses do not change, reads on subsequent frames will always occur from the data cache. We will now detail two other cases:

Virtual addresses are incremented

Virtual addresses cross a cache line boundary.

Virtual addresses are incremented (now 1001H and 1002H: We start from the FIFO read operation. The virtual address (VADDR) stored in the Vcache address table 43 at address 10 (currently 1000H) is compared by comparator 49 with the incoming virtual address (1001H) with the 5 lower bits masked. Therefore, they are found identical. The VALID bit is then set, and no RQST is set. Further read operations will occur from the data cache memory 16 as described before. The same applies to the Vcache address table 43 at address 11.

Virtual addresses cross a cache line boundary (now 101FH and 1020H): Starting from the FIFO read operation, the virtual address (VADDR) stored in the Vcache address table 43 at address 10 (currently 1000H) is compared by comparison circuit 49 with the incoming virtual address (101FH) with the 5 lower bits masked. Therefore they are found identical and the first read will occur from the data cache memory 16 as described before. The virtual address stored in the Vcache address table 43 at address 11 (currently 1001H) is compared with the incoming virtual address (1020H) with the 5 lower bits masked. They are found different. Therefore, the incoming virtual address (1020H) is stored into the Vcache address table 43 at address 11, the valid bit is reset and the request bit is set. The RQST bit processing from the cache manager 71 will then allocate a new cache data line as explained before.

Data Cache Line Allocation and De-Allocation Principle

A data cache line which is not used within a processing frame is de-allocated (made free for new allocation). To do so, two "in-use" register banks 65 and 66 are used, each register bank having the size of the total number of data cache lines. At the beginning of each frame, the "in use" register "Frame" 65 is transferred to the "in use" register "Frame−1" 66 and the "in use" register "Frame" 65 is cleared. Within a frame, each time a data cache line is accessed, the corresponding bit from the "in-use" register "Frame" 65 is set. Therefore, at the end of frame, the "in-use" register "Frame" 65 has bit sets corresponding to all used cache lines, and consequently, the "in use" register "Frame−1" 66 is valid within a full frame. The priority encoder 67 connected to the "in use Frame−1" register 66 indicates the first bit at zero, which is the first available data cache line.

Writing Data to the Sample Memory

Data write requests from the DSP 12 to the sample memory 18 are written directly to a data cache line in the data cache memory 16. A full data cache line is written to the sample memory 18 when the virtual address crosses a cache line boundary (for example from 101FH to 1020H). This is detected by the comparison circuit 49 at FIFO read time when the virtual address stored in the Vcache address table 43 does not match the incoming virtual address on lines 41 (with 5 lower bits masked).

Conversion of Virtual Address to Sample Memory Address

In a PC environment, it is highly desirable to compute a sample memory address different from the DSP virtual address. This allows simple reallocation of PC memory without having to change the DSP program. Also this allows handling of interleaved multichannel audio formats as several monophonic audio streams seen from the DSP.

In the previous description, the Sample memory address output on lines 17 (FIG. 3) was identical to the virtual address (VADDR) provided by the DSP on lines 13. An improvement consists in computing the sample memory address (SMA) as follows:

$$SMA=BASE+((VA*NCHAN)+CHAN)*BYTESPERCHANNEL$$

Where VA is the virtual address, SMA the sample memory address, NCHAN the number of interleaved channels, CHAN the current channel, BYTESPERCHANNEL the number of bytes to code one sample on a channel and BASE a register. To avoid costly multiplications, NCHAN and BYTESPERCHANNEL can be restricted to be powers of two, then the multiplications simply become left shifts.

Another level of sophistication is to have several BASE registers, selected according to VA contents. This allows the PC memory to be segmented, which allows better optimization of the PC memory space.

I claim:

1. A digital sound-producing device, using a sample memory for storing digital audio sample data, the sound-producing device comprising:

a digital signal processor (DSP);

a data cache memory in a data path between said DSP and said sample memory, said data cache memory storing, in cache lines thereof, audio sample data read from said sample memory for use by said DSP and also storing processed audio sample data written thereto by said DSP; and virtual cache memory means in an address path between said DSP and both said sample memory and said data cache memory, said virtual cache memory means receiving virtual addresses from said DSP requesting access to said sample memory, allocating cache lines of said data cache memory to correspond with said virtual addresses, addressing said sample memory for transfer of audio sample data between said sample memory and said allocated cache lines, and addressing said data cache memory at said corresponding allocated cache lines for transfer of audio sample data between said cache lines and said DSP.

2. The device of claim 1 wherein said cache lines of said data cache memory have a bit size matching a bit size of blocks of audio sample data transferred to or from said sample memory.

3. The device of claim 1 wherein said cache lines of said data cache memory have a bit size capable of storing multiple blocks of audio sample data from said sample memory.

4. The device of claim 1 wherein said virtual cache memory means comprises:

an interface receiving at least a current processing slot number, an access request number, and a virtual address from said DSP, said interface having a configuration table storing a designated first virtual cache address for each said slot number, an adder adding said first virtual cache address accessed from said configuration table by said received slot number to said received access request number to obtain a current virtual cache address, and a first-in, first-out (FIFO) memory storing said virtual cache address, said virtual address and a read/write bit received from said DSP;

an address table capable of storing, for each virtual cache address, a virtual address as received from said FIFO memory, a valid bit designating whether a virtual address stored in said address table is a valid current address for that virtual cache address, and a request bit designating which virtual cache addresses correspond to current access requests by said DSP;

a first comparator receiving from said address table said virtual address stored therein at said current virtual cache address and also receiving said virtual address from said FIFO memory, wherein said virtual addresses being equal indicates that audio sample data corresponding to that virtual address is already stored in said data cache memory;

a first priority encoder receiving said request bits from said address table for all of said virtual cache addresses, said encoder outputting a virtual cache address for which its request bit has been set; and a data line table storing, for each virtual cache address, a corresponding data cache address for accessing said data cache memory.

5. The device of claim 4 wherein said virtual cache memory means further comprises:

means connected between said first priority encoder and said data line table for providing, in addition to said virtual cache address, incremented and decremented addresses, said incremented and decremented addresses accessing said address table for reading corresponding virtual addresses therefrom;

registers receiving from said address table said virtual addresses corresponding to said incremented and decremented addresses;

second and third comparators respectively receiving said corresponding virtual addresses from said registers, both said comparators also receiving a virtual address from said address table corresponding to said virtual cache address and outputting a comparison result designating whether said decremented and incremented addresses correspond to said virtual cache address, said means for providing said incremented and decremented addresses also accessing said data line table subsequent to a positive comparison result.

6. The device of claim 4 wherein said virtual cache memory means further comprises:

first and second in-use register banks connected in series to a data output of said data line table, said in-use register banks storing bits designating data cache addresses stored in said data line table in a current processing time frame and a previous processing time frame, respectively;

a priority encoder connected to an output of said second in-use register bank and to a data input of said data line table, said priority encoder providing a first available data cache address to said data line table for allocation to a virtual cache address.

7. A method, in a digital sound-producing device, for accessing audio sample data corresponding to a sample memory address specified by a digital signal processor (DSP) of the device, the method comprising the steps of:

providing a data cache memory in a data path between said DSP and a sample memory and providing a virtual cache memory block in an address path between said DSP and both said sample memory and said data cache memory;

receiving a virtual address from said DSP by said virtual cache memory block, said virtual address representing a request by said DSP for access to audio sample data at a corresponding sample memory address;

determining whether said received virtual address corresponds to an allocated cache line of said data cache memory, and if not, then allocating a cache line of said data cache memory as corresponding to said virtual address and, for a read request, transferring audio sample data from said corresponding sample memory address of said sample memory to said newly allocated cache line of said data cache memory; and addressing, in a subsequent processing time frame, said data cache memory at a cache line allocated to said virtual address and transferring audio sample data between said allocated cache line and said DSP.

8. The method of claim 7 wherein a complete transfer of audio sample data to and from cache lines of said data cache memory comprises a burst of successive transfers of blocks of audio sample bits, wherein said cache lines have a bit size capable of storing multiple blocks of audio sample data.

9. The method of claim 7 wherein receiving said virtual address comprises:

accessing a configuration table with a current processing slot number received from said DSP, said configuration table storing a designated first virtual cache address for each said slot number;

adding said first virtual cache address accessed from said configuration table for said received slot number with an access request number also received from said DSP to obtain a current virtual cache address; and storing said current virtual cache address, said received virtual address, and a read/write request bit in a first-in, first-out (FIFO) memory.

10. The method of claim 9 wherein determining whether said received virtual address already corresponds to an allocated cache line of said data cache memory comprises:

accessing a virtual address field of an address table at said current virtual cache address of said address table received from said FIFO memory; and comparing contents of said accessed virtual address field read from said address table with said received virtual address stored in said FIFO memory, a positive comparison indicating that said cache line is already allocated and a negative comparison indicating that a cache line has not yet been allocated as corresponding to said received virtual address.

11. The method of claim 10 wherein allocating a cache line comprises:

storing in said address table, at said current virtual cache address, said received virtual address; and storing in a data line table, at said current virtual cache address, a corresponding cache line of said data cache memory.

12. The method of claim 11 wherein allocating a cache line further comprises:

storing in said address table, at an incremented address relative to said current virtual cache address, said received virtual address; and storing in said data line table, at said incremented address, another corresponding cache line of said data cache memory.

13. The method of claim 7 further comprising de-allocating cache lines of said data cache memory as no longer corresponding to a virtual address whenever said virtual address is not received by said virtual cache memory block in a specified number of processing time frames.

14. The method of claim 13 wherein de-allocating cache lines includes transferring audio sample data stored in said data cache memory at said cache lines being de-allocated back to said sample memory at a sample address corresponding to said virtual address.

* * * * *